US007069914B2

(12) United States Patent
Nagata

(10) Patent No.: US 7,069,914 B2
(45) Date of Patent: Jul. 4, 2006

(54) FUEL FEED APPARATUS HAVING SUB TANK AND JET PUMP

(75) Inventor: Kiyoshi Nagata, Nagoya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/236,809

(22) Filed: Sep. 28, 2005

(65) Prior Publication Data

US 2006/0021603 A1 Feb. 2, 2006

Related U.S. Application Data

(62) Division of application No. 10/793,039, filed on Mar. 5, 2004, now Pat. No. 6,981,490.

(30) Foreign Application Priority Data

Mar. 13, 2003 (JP) ..... 2003-68320
Mar. 28, 2003 (JP) ..... 2003-90908
Apr. 17, 2003 (JP) ..... 2003-112660

(51) Int. Cl.
*F02M 33/02* (2006.01)

(52) U.S. Cl. ..... 123/509; 123/514

(58) Field of Classification Search ..... 123/509, 123/514; 417/76, 80, 84, 79, 248
See application file for complete search history.

(56) References Cited

U.S. PATENT DOCUMENTS 5,078,169 A * 1/1992 Scheurenbrand et al. ... 137/574
5,080,077 A 1/1992 Sawert et al.
5,396,872 A 3/1995 Ruger et al.
5,732,684 A * 3/1998 Thompson ..... 123/514
6,260,543 B1 7/2001 Chih
6,283,142 B1 * 9/2001 Wheeler et al. ..... 137/265
6,457,945 B1 10/2002 Kleppner et al.
6,502,558 B1 1/2003 Brunel
6,505,644 B1 1/2003 Coha et al.
6,513,503 B1 2/2003 Iwamoto et al.
6,532,941 B1 * 3/2003 Begley et al. ..... 123/497
6,708,673 B1 3/2004 Herzok et al.
6,832,602 B1 * 12/2004 Tanimura ..... 123/509
6,907,899 B1 * 6/2005 Yu et al. ..... 137/565.22
2003/0062031 A1 4/2003 Tanimura
2003/0159681 A1 8/2003 Schueler et al.
2003/0226548 A1 12/2003 Herzog et al.
2004/0237941 A1 12/2004 Sinz

FOREIGN PATENT DOCUMENTS

JP A-5-2830 5/1993
JP A-7-63133 3/1995
JP A-2001-20900 1/2001

* cited by examiner

*Primary Examiner*—Thomas Moulis
(74) *Attorney, Agent, or Firm*—Nixon & Vanderhye PC

(57) ABSTRACT

A fuel feed apparatus including a sub-tank is received in a fuel tank having multiple tank sections. Multiple jet pumps respectively transfers fuel received in the tank sections into the sub-tank. Therefore, even if a fuel amount received in a single tank section decreases, fuel can be steadily supplied from another tank section. Intermediately pressurized fuel in a fuel pump is supplied to the jet pumps, so that fuel can be steadily supplied to the jet pumps regardless of fuel consumption amount in an engine. Fuel is drawn from an upstream side of a pressure regulator, and supplied to the jet pump. The pressure regulator has an urging unit, and controls fuel pressure without using a diaphragm. Therefore, the pressure regulator is simplified and downsized.

7 Claims, 10 Drawing Sheets

FUEL FEED APPARATUS HAVING SUB TANK AND JET PUMP

CROSS REFERENCE TO RELATED APPLICATIONS

This application is a division of application Ser. No. 10/793,039 filed Mar. 5, 2004 which is based on Japanese Patent Application No. 2003-90908 filed on Mar. 28, 2003, No. 2003-112660 filed on Apr. 17, 2003 and No. 2003-68320 filed on Mar. 13, 2003, the disclosures of all of the above applications are incorporated herein by reference.

BACKGROUND OF THE INVENTION

1. Field of the Invention

The present invention is related to a fuel feed apparatus that transfers fuel received in a fuel tank having multiple inner tank sections into a sub-tank received in the fuel tank, and supplies the fuel received in the sub-tank to an internal combustion engine.

2. Description of Related Art

A fuel feed apparatus including a fuel pump is provided in a fuel tank having multiple tank sections in a related art (e.g., JP-A-5-2830). In this case, fuel is jetted from the fuel pump into a tank section where the fuel pump is received, so that suction pressure is generated for transferring fuel received in another tank section toward the fuel pump.

Besides, if fuel is decreased in the tank section where the fuel pump is received, the fuel pump cannot draw fuel in the tank section. In this case, fuel in another tank section cannot be drawn by the fuel pump. Accordingly, the fuel pump cannot draw fuel received in the tank section and fuel received in the other tank section.

In another case, a fuel feed apparatus includes a sub-tank receiving a fuel pump in a fuel tank (e.g., U.S. Pat. No. 6,457,945 B2/JP-A-2001-207929). If the fuel tank includes multiple tank sections, and if multiple jet pumps are received in the other tank sections for drawing fuel, fuel received in the other tank sections can be supplied to the sub-tank. Therefore, fuel can be secured in the sub-tank, even when fuel in the sub-tank decreases. However, if the jet pump is installed outside of the sub-tank, fuel is discharged from outside of the sub-tank, and the discharged fuel may not be supplied into the sub-tank when the vehicle is inclined, for example. In this case, fuel received in the sub-tank may decrease.

Fuel returned from a pressure regulator is used in a jet pump in a generally known fuel feed apparatus (e.g., JP-A-2001-20900). In detail, surplus fuel is generated and exhausted from the pressure regulator as return fuel. The return fuel is supplied to the jet pump (drawing pump), so that fuel in the fuel tank is supplied into the sub-tank. The return fuel can be also supplied to a jet pump (transfer pump) used for transferring fuel received in another tank section in the fuel tank into the sub-tank.

However, in this case, when an amount of pressure-controlled fuel discharged from the pressure regulator is increased, an amount of the return fuel exhausted from the pressure regulator decreases. Subsequently, an amount of fuel (return fuel) supplied to both of the jet pumps decreases, and an amount of fuel supplied into the sub-tank by both of the jet pumps decreases. Here, the jet pumps are the drawing pump and the transfer pump. As a result, an amount of fuel received in the sub-tank decreases, and the fuel pump may not properly draw fuel received in the sub-tank.

By contrast, if a consumption amount of fuel drawn from the sub-tank is decreased, the amount of return fuel (i.e., fuel exhausted from the pressure regulator) increases. In this case, the amount of fuel supplied to both of the jet pumps increases, and the amount of fuel supplied into the sub-tank increases. As a result, a large amount of fuel may overflow from the sub-tank, and the overflowing fuel may agitate fuel received in the fuel tank. In this case, vapor of fuel may be generated. Besides, noise may be generated when fuel overflowing from the sub-tank drops onto the inner wall of the fuel tank.

Surplus fuel returning from an internal combustion engine may be supplied to the jet pump, instead of the fuel exhausted from the pressure regulator. However, in this case, an amount of fuel consumed in the engine varies due to a change of an operation condition. In this case, the amount of fuel received in the sub-tank changes.

In a generally known fuel feed apparatus, pressure-controlled fuel is supplied to a jet pump from a pressure regulator having a diaphragm (e.g., U.S. Pat. No. 6,502,558 B1/WO99-61777). In this structure, the diaphragm is used for preventing a control characteristic of the pressure regulator from changing due to pressure variation in the downstream side of the pressure regulator. However, if the diaphragm is used in the pressure regulator, the structure of the pressure regulator becomes complicated. Furthermore, the diaphragm needs sufficient surface area for receiving pressure. Accordingly, it becomes difficult to downsize the pressure regulator, if the diaphragm is used in the pressure regulator.

SUMMARY OF THE INVENTION

In view of the foregoing problems, it is a first object of the present invention to provide a fuel feed apparatus, in which multiple jet pump supply fuel from multiple tank sections, so that fuel can be secured in the sub-tank. The second object of the present invention is to provide a fuel feed apparatus, in which variation of the amount of fuel received in the sub-tank can be decreased, regardless of the amount of fuel supplied from the sub-tank. The third object of the present invention is to provide a fuel feed apparatus having a small pressure regulator. The pressure regulator has a simple structure, and is capable to stably control fuel pressure.

According to the present invention, a fuel feed apparatus is received in a first-tank section included in a fuel tank. The fuel tank has multiple tank sections. The fuel feed apparatus supplies fuel received in the fuel tank to outside of the fuel tank. The fuel feed apparatus includes a sub-tank, a pump module, a first jet pump and a second jet pump. The sub-tank is received in the first-tank section. The pump module is received in the sub-tank. The pump module draws fuel received in the sub-tank and pressurizes the fuel. The first jet pump is arranged in the first-tank section for generating suction power by jetting fuel for supplying fuel received in the first-tank section into the sub-tank. The second jet pump is arranged in the sub-tank for generating suction power by jetting fuel for supplying fuel received in a second-tank section into the sub-tank. The second-tank section is included in the fuel tank.

Fuel is jetted from the first jet pumps and the second jet pump, so that the sub-tank is filled with fuel, even if an amount of fuel received in the first-tank section or an amount of fuel received in the second-tank section decreases.

Alternatively, the fuel feed apparatus includes a fuel pump. The fuel pump is received in the sub-tank for drawing fuel received in the sub-tank and pressurizing the fuel. The second jet pump generates suction power by jetting fuel for supplying fuel received in the second-tank section into the first-tank section. Fuel pressurized in the fuel pump is partially supplied to the first jet pump and the second jet pump.

Specifically, the first jet pump and the second jet pump are connected with a vent hole of the fuel pump. An amount of fuel supplied from the vent hole to the jet pumps is substantially constant, regardless of a fuel consumption amount in an engine side. Accordingly, substantially constant fuel amount can be secured in the sub-tank regardless of a fuel consumption amount in the engine side. Therefore, fuel shortage in the sub-tank can be prevented. Besides, overflowing a large amount of fuel from the sub-tank into the fuel tank and the first-tank section can be also prevented.

Alternatively, a fuel feed apparatus is provided in a fuel tank. The fuel feed apparatus includes a fuel pump, a fuel pipe, a pressure regulator and a jet pump. The fuel pump is received in the fuel tank for pumping fuel received in the fuel tank. Fuel is pressurized in the fuel pump, and flows to an internal combustion engine through the fuel pipe. The pressure regulator exhausts fuel flowing from the fuel pipe. The pressure regulator includes a valve port, a valve seat, a valve body and an urging unit. The valve port is communicated with the fuel pipe. The valve seat is located at a downstream of the valve port, and connected with the valve port. The valve body is arranged at a downstream of the valve seat. The urging unit urges the valve body in a direction where the valve body seats on the valve seat. The jet pump is connected with an upstream of the valve port for introducing fuel pressurized in the fuel pump. The jet pump jets the fuel for flowing fuel received in the fuel tank by negative pressure generated by the jetting fuel.

In this case, fuel is supplied to the jet pump from the upstream side of the valve port of the pressure regulator. Therefore, variation of a pressure control characteristic of the pressure regulator does not be largely affected by the jet pump, in this structure. Therefore, the structure of the pressure regulator can be simplified, while securing stable control characteristic of the pressure regulator.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

[First Embodiment]

Figure 1:
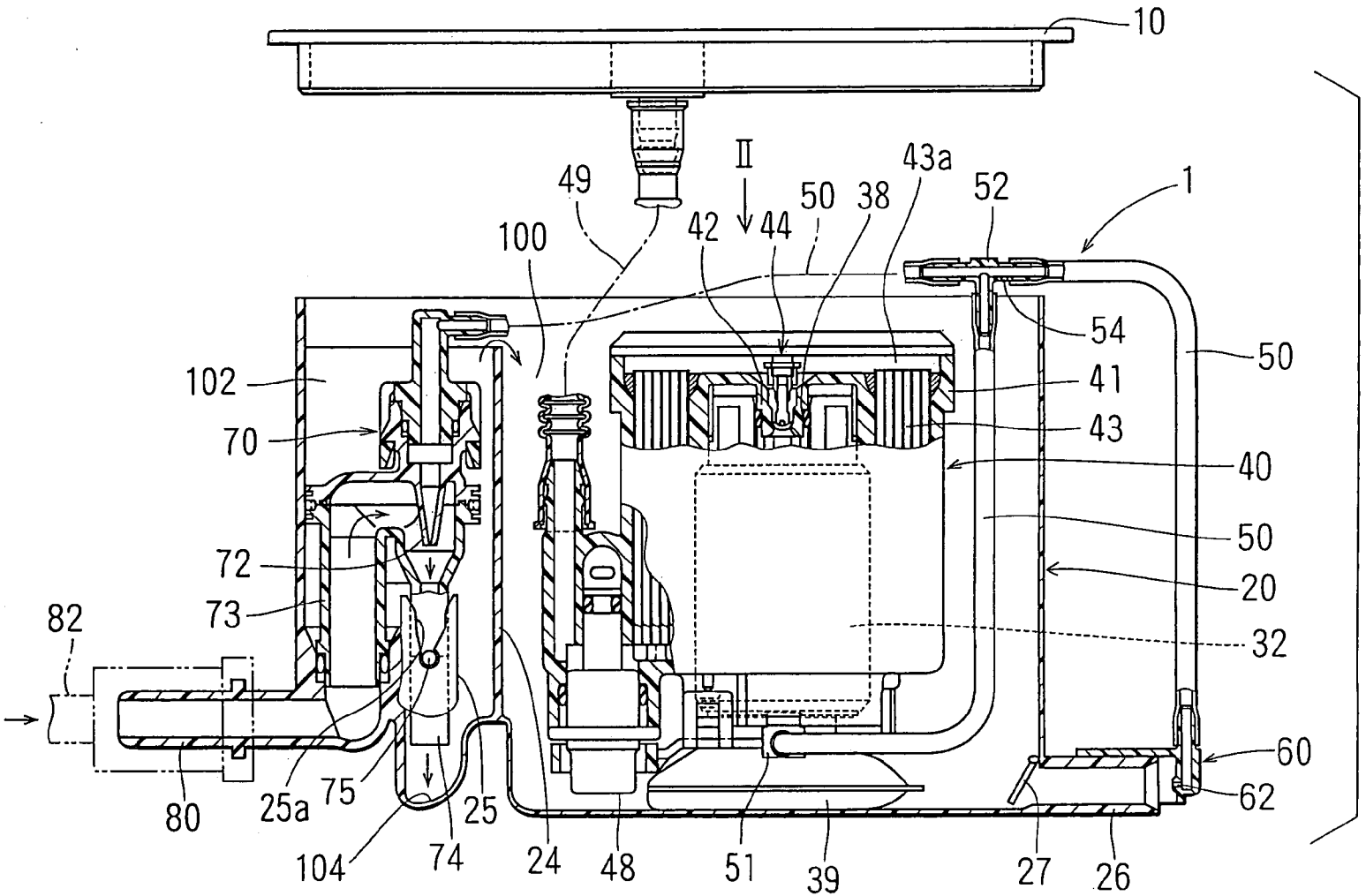
FIG. 1 is a cross-sectional side view showing a fuel feed apparatus according to the present invention.
Figure 2:
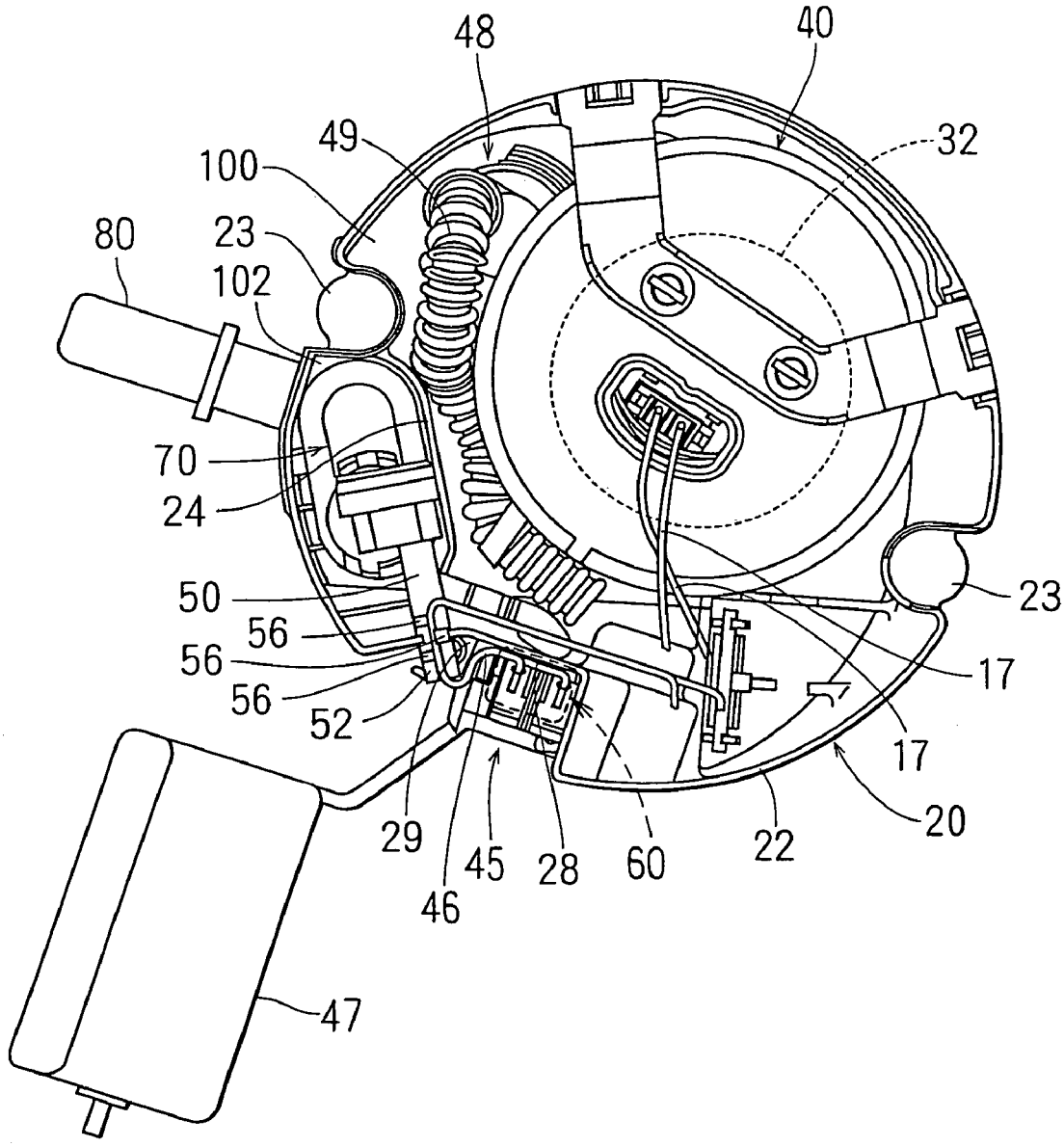
FIG. 2 is a top view from the direction II in FIG. 1.

As shown in FIGS. 1 and 2, a fuel feed apparatus 1 is received in a fuel tank 2 for transferring fuel in the fuel tank 2 to an exterior device, such as engine, provided outside of the fuel tank 2. The fuel feed apparatus 1 includes a flange 10, a sub-tank 20, a pump module 40, a jet pump 60 (first jet pump), a jet pump 70 (second jet pump) and the like. FIG. 1 shows a cross-sectional view taken along a polygonal line passing the jet pump 60, a pressure regulator 48 and the jet pump 70 in FIG. 2. Here, the jet pump 60 is located under a sender gauge 45, and is not shown in FIG. 2. Therefore, the cross-sectional view shown in FIG. 1 is wider than a cross-sectional view taken along a straight line. The flange 10 is formed in a disc-shape and used as a lid in the fuel feed apparatus 1.

Referring back to FIG. 1, the pump module 40 includes a filter case 41 and a filter element (fuel filter) 43. The filter case 41 surrounds the outer periphery of the fuel pump 32. The filter element 43 is received in the filter case 41 and has an inlet port 43*a* through which fuel discharged from the fuel pump 32 flows into the filter element 43. The filter case 41 has an inlet port 42. The inlet port 42 is fitted to the discharge port 38 of the fuel pump 32, and connected to the discharge port 38. A check valve 44 is received in the inlet port 42 of the filter case 41. The check valve 44 prevents fuel discharged by the fuel pump 32 from reverse flow into the fuel pump 32.

Figure 3:
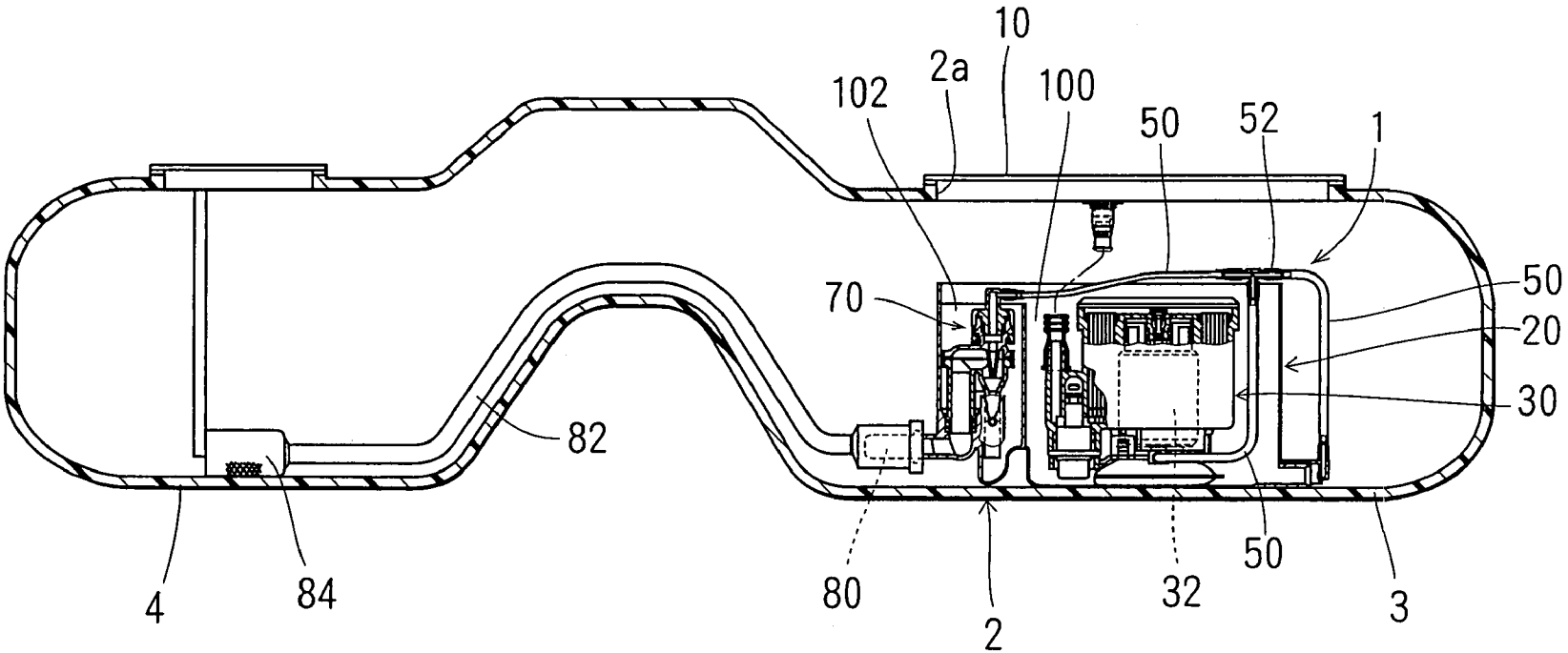
FIG. 3 is a cross-sectional side view showing the fuel feed apparatus received in a fuel tank.

As shown in FIG. 3, the flange 10 is provided on the upper wall of the fuel tank 2 to cover an opening 2*a* of the fuel tank 2. The fuel tank 2 is formed in a saddle-shape, and includes a first-tank section 3 and a second-tank section 4. The first-tank section 3 receives the sub-tank 20. The second-tank section 4 does not receive the sub-tank 20.

A fuel discharge pipe and an electric connector (not shown) are provided on the flange 10. The fuel feed apparatus 1 is received in the fuel tank 2 except for the flange 10.

The sub-tank 20 is formed in a bottomed cylindrical shape. A sidewall 22 of the sub-tank 20 is partially recessed in the diametrical direction of the sub-tank 20, so as to form a step section 28 as shown in FIG. 2. The sub-tank 20 is formed in a substantially cylindrical shape, except for the step section 28. The step section 28 is formed to be flat. The jet pump 60 and a sender gauge 45 are provided in the step section 28. A shaft (not shown) is press-inserted into the flange 10 on one side, and loosely inserted into an insertion section 23 formed in the sub-tank 20. Specifically, the insertion section 23 is formed in a section of the sidewall 22 which is recessed in the diametrical direction of the sub-tank 20. Accordingly, the shaft and the insertion section 23 do not outwardly protrude from the sub-tank 20. Therefore, the project area of the sub-tank 20 is reduced. The flange 10 and the sub-tank 20 are urged by a spring (not shown) to be apart from each other. The flange 10 and the sub-tank 20 receiving the pump module 40 are vertically movable from each other. The fuel tank 2, which receives the fuel feed apparatus 1, expands and shrinks due to a temperature change and a pressure change. Even in this case, the bottom side of the sub-tank 20 is pressed onto the inner bottom wall of the fuel tank 2.

Figure 5:
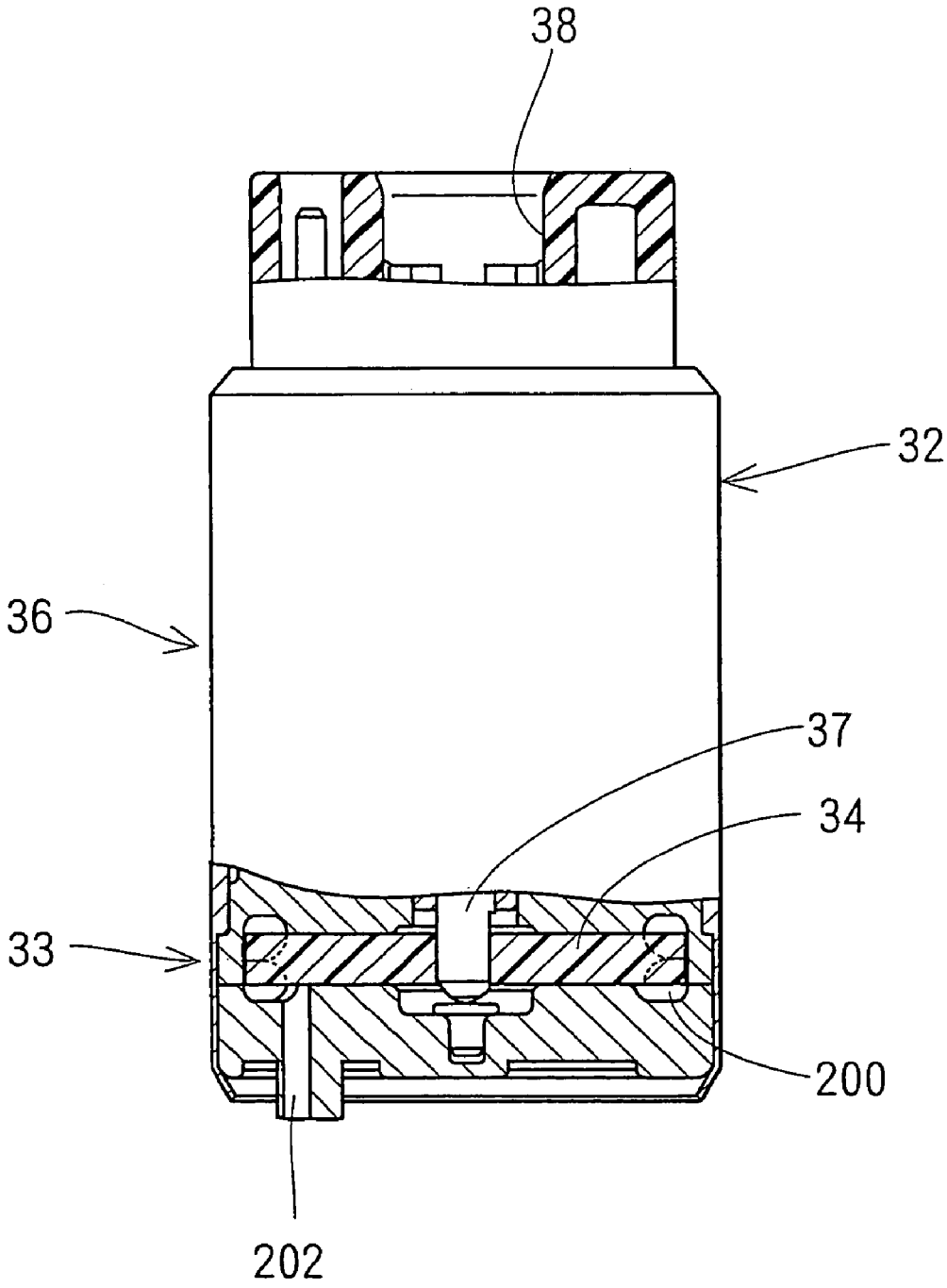
FIG. 5 is a partially cross-sectional view showing the fuel pump of a fuel feed apparatus.

The inner space of the sub-tank 20 is partitioned into a main chamber (first chamber) 100 and an auxiliary chamber (second chamber) 102 by a partition wall 24. The pump module 40 (FIG. 1) is received in the main chamber 100. The pump module 40 includes a fuel pump 32, a fuel filter 41, a suction filter 39, a pressure regulator 48 and the like. As shown in FIG. 5, the fuel pump 32 includes rotating members, such as a motor 36 and an impeller (rotating member) 34 rotated by the motor 36, for generating suction power. The fuel pump 32 draws fuel received in the sub-tank 20 through the suction filter 39 (FIG. 1).

Fuel is discharged from the fuel pump 32. Debris included in the fuel discharged from the fuel pump 32 is removed by the suction filter 39. Pressure of the fuel after passing through the filter 36 is controlled by the pressure regulator 48. The pressure-controlled fuel is supplied outside of the fuel tank 2 after passing through a flexible tube 49 and the flange 10.

The first jet pump 60 is provided at an inlet port 26 located on the outside of the sub-tank 20 for drawing fuel received in the fuel tank 2. The second jet pump 70 is received in the auxiliary chamber 102 for drawing fuel received in the second-tank section 4. A check valve 27 prevents fuel received in the main chamber 100 from flowing out of the sub-tank 20 through the inlet port 26.

As shown in FIG. 2, the pump module 40 is eccentrically received in the main chamber 100 of the sub-tank 20. Specifically, the pump module 40 is located in the vicinity of the sidewall 22 of the sub-tank 20, and received in the sub-tank 20 eccentrically in the diametrical direction of the sub-tank 20.

The first jet pump 60 and the second jet pump 70 are located on the substantially opposite side of the pump module 40 in the diametrical direction of the sub-tank 20. The first jet pump 60 is provided outside of the sub-tank 20 and the second jet pump 70 is provided in the sub-tank 20, and the jet pumps 60, 70 are located to be approximated each other. Accordingly, passage length of the fuel supplied from the pump module 40 to both of the jet pumps 60, 70 can be decreased. Therefore, pressure drop of the fuel supplied from the pump module 40 to both of the jet pumps 60, 70 can be largely decreased.

An air-vent port (vent hole) 202 (FIG. 5) is formed around the impeller 34 in the fuel pump 32. The vent hole 202 and the jet pumps 60, 70 are connected with three flexible nylon tubes 50 and a resinous connecting member 52. The connecting member 52 connects the three nylon tubes 50 at one ends of the nylon tubes 50. Fuel is discharged from the vent hole 202 located at a pressurizing section 33 (FIG. 5) of the fuel pump 32 toward the jet pumps 60, 70. In detail, the pressurizing passage 200 is formed along with an outer periphery of the impeller 34. The pressurizing passage 200 is formed in a C-shape. The vent hole 202 is formed in the midstream of the pressurizing passage 200. Fuel received in the sub-tank 20 is drawn through the suction filter 39, and flows into the C-shaped pressurizing passage 200 formed along with an outer periphery of the impeller 34. Fuel drawn into the pressurizing passage 200 is pressurized by rotation of the impeller 34 in the rotation direction of the impeller 34. The fuel pressurized in the pressurizing passage 200 is discharged from the discharge port 38 through the motor section 36.

One of the nylon tubes 50 (FIG. 1) is connected to the vent hole 202 with a connecting member 51. Fuel is pressurized in the pressurizing passage 200 and drawn from the vent hole 202 located in the midstream of the pressurizing passage 200. The fuel drawn from the vent hole 202 is supplied to the jet pumps 60, 70 after passing through the connecting member 51, the nylon tube 50, the connecting member 52 and either of the nylon tubes 50 connected to the jet pumps 60, 70. Location of the vent hole 202 can be adjusted in the rotating direction of the impeller 34 in the pressurizing passage 200. Pressure of fuel discharged from the fuel pump 32 to the jet pumps 60, 70 can be easily controlled by the adjustment of the location of the vent hole 202. Fuel discharge amount can be also changed by the adjustment of the location of the vent hole 202 in accordance with a fuel consumption amount of the engine or the like. The vent hole 202 is also used for removing air in the pressurizing passage 200 when the fuel pump 32 is started.

Fuel pressurized by the fuel pump 32 can be supplied through another pathway to the jet pumps 60, 70, instead of the vent hole 202. For example, pressure-controlled fuel after passing through the fuel filter 41 and the pressure regulator 48 can be partially divided and supplied to the jet pumps 60, 70.

Fuel is pressurized immediately after being drawn into the pressurizing section 33 of the fuel pump 32 until the fuel is discharged to the engine. Here, a branch section can be provided in a fuel passage between the section where the fuel is initially pressurized in the fuel pump 32 and the engine where the fuel is finally consumed. Fuel can be supplied to the jet pumps 60, 70 from the branch section where pressurized fuel is drawn. In this case, excessive fuel is not returned from the engine. Alternatively, exhausted fuel from the pressure regulator 48 can be supplied to the jet pumps 60, 70.

The nylon tubes 50 are located outside of the sub-tank 20. The nylon tubes 50 are hooked and secured by an arc section 29 (FIG. 2) formed on the sidewall 22 of the sub-tank 20. Fuel passages through which fuel is supplied from the pressurizing section 33 of the fuel pump 32 to the jet pumps 60, 70 are bent on the upper end section of the sidewall 22 of the sub-tank 20. The connecting member 52 fits to the upper end section of the sidewall 22 where the fuel passage is bent. A vent hole 54 is formed in the connecting member 52 to be oriented to the inner area (upper opening area) of the sub-tank 20. Three claws 56 are formed in the connecting member 52 on the diametrically opposite side of the vent hole 54. A lead wire 46 is hooked on the claws 56 for transmitting signal output from the sender gauge 45 to the side of the flange 10. A float 47 is connected to the sender gauge 45 to be rotatable in the same direction in which an inlet port 80 protrudes from the sub-tank 20. Therefore, the fuel feed apparatus 1 can be installed in the fuel tank 2 from the side of the inlet port 80 and the float 47 into the opening 2*a* of the fuel tank 2.

The first jet pump 60 (FIG. 1) jets fuel from the nozzle 62, so that fuel received in the first-tank section 3 (FIG. 3) is supplied into the main chamber 100 of the sub-tank 20 from the inlet port 26. The second jet pump 70 jets fuel from a nozzle 72, so that fuel received in the second-tank section 4 is supplied into the auxiliary chamber 102 of the sub-tank 20 through the filter 84, the transfer pipe 82 and the inlet port 80. Therefore, the sub-tank 20 can be regularly filled with fuel even if a fuel amount in the first-tank section 3 or a fuel amount in the second-tank section 4 are decreased.

The jet pump 70 has the nozzle 72, an inlet pipe 73 and an outlet pipe 74. The jet pump 70 jets fuel from the nozzle 72 to the bottom section of the auxiliary chamber 102 of the sub-tank 20. The jet pump 70 is vertically provided along with the depth direction of the auxiliary chamber 102. Therefore, the sub-tank 20 can be downsized compared with a case in which the jet pump 70 is horizontally provided.

The inlet pipe 73 fits to an inner wall of the sub-tank 20 in the auxiliary chamber 102. The inlet pipe 73 communicates with the inlet port 80 and the nozzle 72. The outlet pipe 74 opens into the auxiliary chamber 102. Fuel received in the second-tank section 4 is drawn by fuel jetted by the jet pump 70, and transferred into the auxiliary chamber 102 through the transfer pipe 82, the inlet port 80, the inlet pipe 73 and the outlet pipe 74.

Figure 4A:
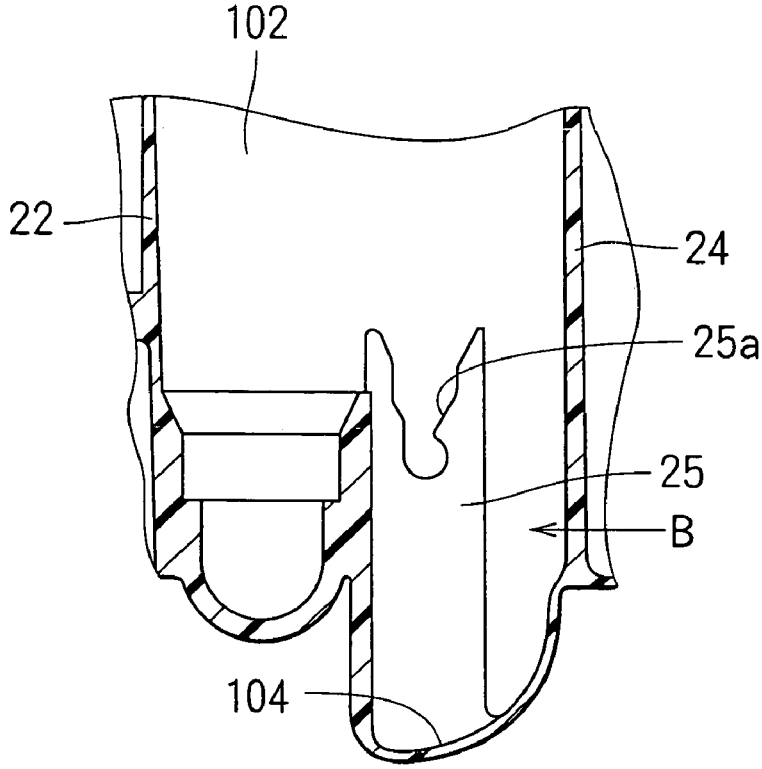
FIG. 4A is an enlarged schematic cross-sectional view showing a receiving section of a jet pump in a sub-tank.
Figure 4B:
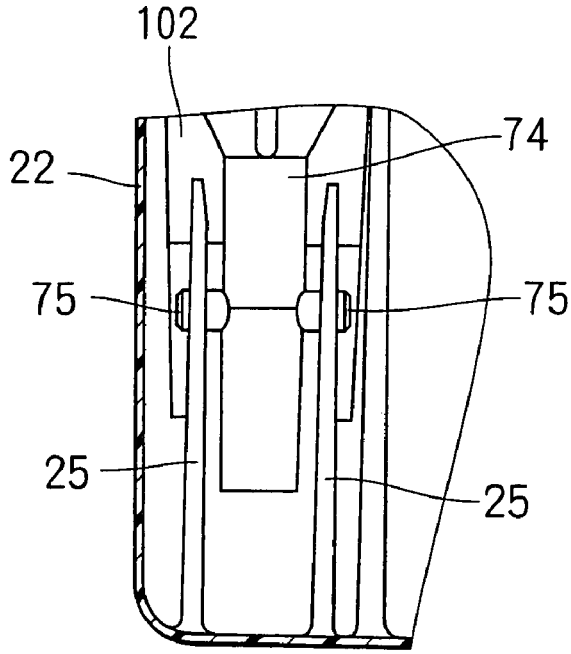
FIG. 4B is an enlarged schematic cross-sectional view showing the receiving section and the jet pump from the arrow B in FIG. 4A.

As shown in FIGS. 4A and 4B, the outlet pipe 74 has protrusions 75 on the outer surface of the outlet pipe 74. The protrusions 75 protrude in the diametrical direction of the outlet pipe 74 oppositely each other. The sub-tank 20 has supporting plates 25 protruded from the bottom section of the auxiliary chamber 102. The supporting plates 25 oppose each other. A recess section 25*a* is a notch formed in each supporting plate 25. The recess section 25*a* is formed in a shape in which width of its opening decreases from the upper side to the lower side of the recess section 25*a*. Each protrusion 75 of the outlet pipe 74 fits to corresponding recess section 25*a* each other, when the outlet pipe 74 is connected to the supporting plates 25. Each bottom section of the recess-sections 25*a* is formed in a circular shape which has an opening on its upper side. The circular-shaped bottom section of the recess section 25*a* becomes narrow on the opening side (upper side). Therefore, once the protrusions 75 fit to the recess sections 25*a*, the protrusions 75 are not be easily pulled out of the recess sections 25*a*.

A fuel accumulator 104 is formed in the bottom section of the auxiliary chamber 102, into which the jet pump 70 jets fuel. The engine is started, and the fuel pump 32 is started, so that fuel is supplied from the fuel pump 32 to the nozzle 72 of the jet pump 70, and jetted from the nozzle 72. The fuel jetted from the nozzle 72 is accumulated in the fuel accumulator 104 and filled around the nozzle 72. Therefore, even in case that fuel is not filled around the nozzle 72 of the jet pump 70, when the engine is started for example, fuel can be immediately filled around the nozzle 72. The fuel is filled around the nozzle 72, and a liquid seal is formed around the nozzle 72, so that suction power is generated by the nozzle 72. Thus, fuel received in the second tank section 4 can be immediately supplied into the sub-tank 20, when the engine is started. Because the fuel accumulator 104 is formed in a section where the jet pump 70 jets fuel.

Next, an operation of the fuel feed apparatus 1 is described. The fuel pump 32 is driven, and fuel is pressurized in the fuel pump 32. The fuel is controlled in pressure by the pressure regulator 48, and supplied to the engine through the flexible tube 49.

Specifically, fuel is pressurized in the pressurizing passage 200 (FIG. 5) of the fuel pump 32 and partially drawn from the vent hole 202 located in the midstream of the pressurizing passage 200. The fuel drawn from the vent hole 202 is supplied to the jet pumps 60, 70 through the vent hole 202, the nylon tube 50, connecting member 52 and the nylon tubes 50 connected to the jet pumps 60, 70 respectively. The jet pump 60 jets the fuel supplied from the vent hole 202, and generates suction power, so that fuel received in the first-tank section 2 is drawn into the sub-tank 20 from the inlet port 26. A small amount of the fuel supplied from the fuel pump 32 to the jet pump 60 leaks from the vent hole 54 of the connecting member 52. However, the location of the vent hole 54 is included in the upper opening area of the sub-tank 20, so that fuel leaked from the vent hole 54 returns to the sub-tank 20.

Fuel is supplied from the fuel pump 32 and jetted from the nozzle 72 of the jet pump 70. Fuel received in the second-tank section 4 is drawn by the fuel jetted from the nozzle 72, and passes through the transfer pipe 82 and the inlet port 80. The fuel drawn from the second-tank section 4 is supplied into the auxiliary chamber 102 and flows into the main chamber 100 after flowing over the partition wall 24.

Fuel is jetted from the jet pumps 60, 70, so that the sub-tank 20 is filled with fuel, even if an amount of fuel received in the first-tank section 3 or an amount of fuel received in the second-tank section 4 decreases.

That is, fuel pressurized in the fuel pump 32 is drawn from the midstream of the pressurizing section 33, and jetted from the jet pumps 60, 70, in this structure of the fuel feed apparatus 1. The fuel drawn from the midstream of the pressurizing section 33 is not completely pressurized. Pressure of the fuel is further increased immediately after the fuel is drawn into the fuel pump 32 until the fuel is discharged from the discharge port 38. The drawn fuel (low-pressure suction fuel) becomes high-pressure discharged fuel. The intermediately pressurized fuel is drawn from the vent hole 202. Therefore, if the location of the vent hole 202 is changed, pressure of the fuel supplied to both of the jet pumps 60, 70 can be changed. Accordingly, an amount of fuel supplied into the sub-tank 20 can be adjusted in accordance with a performance needed to the fuel feed apparatus 1, so that fuel received in the sub-tank 20 can be set at a substantially constant amount.

When the fuel pump 32 is stopped, fuel accumulated in the nylon tubes 50 connected to the jet pumps 60, 70, is drawn from the nozzles 62, 72 by gravity. Therefore, fuel accumulated in the horizontally located nylon tubes 50 is pulled by the fuel drawn from the nozzles 62, 72 by gravity. If the vent hole 54 is not formed in the connecting member 52, fuel accumulated in the fuel pump 32 is pulled by the fuel drawn from the nylon tubes 50 by gravity. In this case, fuel in the sub-tank 20 may be drawn out of the sub-tank 20 through a fuel passageway, when the fuel pump 32 is stopped. In detail, the fuel passageway is constructed by the pressurizing section 33 of the fuel pump 32, the nylon tube 50, the connecting member 52, the nylon tubes 50 and the jet pumps 60, 70, in order.

By contrast, the vent hole 54 is formed in the connecting member 52, and located in the vicinity of the upper end section of the sidewall 22 of the sub-tank 20 in the structure of the present invention. Accordingly, when the engine is stopped, and the fuel pump 32 is stopped, air intrudes into the vent hole 54 of the connecting member 52. Fuel accumulated in the nylon tubes 50 is respectively exhausted from the nozzles 62, 72 and the vent hole 202 of the fuel pump 32. Therefore, even if the fuel pump 32 is stopped, fuel received in the main chamber 100 of the sub-tank 20 is prevented from flowing out of the sub-tank 20 through the fuel passageway.

Besides, the check valve 27 prevents fuel received in the main chamber 100 from flowing out of the sub-tank 20 through the inlet port 26. Therefore, liquid level in the main chamber 100 does not decrease, when the fuel pump 32 is stopped.

When liquid level in the auxiliary chamber 102 is higher than liquid level in the second-tank section 4, and if the fuel pump 32 is stopped, fuel flows out of the auxiliary chamber 102. In detail, fuel received in the auxiliary chamber 102 flows to the second-tank section 4 through the outlet pipe 74, the inlet pipe 73, the inlet port 80 and the transfer pipe 82. However, the main chamber 100 is partitioned from the auxiliary chamber 102 by the partition wall 24. Accordingly, fuel received in the main chamber 100 does not flow into the auxiliary chamber 102 over the partition wall 24. Therefore, fuel received in the main chamber 100 can be prevented from flowing out of the sub-tank 20 through the auxiliary chamber 102 and the inlet port 80. Thus, liquid level in the main chamber, where the pump module 40 is received, can be secured while the fuel pump 32 is stopped. That is, the partition wall 24 is used as a reverse flow preventing unit for preventing fuel received in the main chamber 100 from flowing out of the sub-tank 20 through the inlet port 80.

A check valve can be provided in the fuel passage way in which fuel is supplied from the second-tank section 4 to the sub-tank 20, instead of forming the partition wall 24 in the sub-tank 20. In this case, the check valve is used for preventing fuel received in the sub-tank 20 from reverse flowing to the outside of the sub-tank 20. The location, where the check valve is provided, is preferably in the downstream side of the nozzle 72 of the jet pump 70, in consideration of an efficiency of a fuel amount transferred from the second-tank section 4 to the sub tank 20. Because the check valve can be easily opened in the forward direction of the fuel flow, by the fuel jetted from the jet pump 70. If the check valve is provided in the inlet pipe 73 located on the upstream side of the nozzle 72 of the jet pump 70, suction power needed for the jet pump 70 becomes large, and drawing fuel from the second-tank section 4 becomes difficult.

The jet pump 70 is received in the sub-tank 20, so that fuel supplied from the fuel pump 32 to the jet pump 70 is steadily jetted into the sub-tank 20. When the vehicle is inclined, or the vehicle turns and swings, the jet pumps 60, 70 are exposed to air. In this case, fuel cannot be supplied from the first-tank section 3 and the second-tank section 4 into the sub-tank 20. Even in this case, fuel for driving the jet pumps 60, 70 can be steadily returned to the sub-tank 30.

Fuel is supplied from the fuel pump 32 to the engine and the amount of fuel in the sub-tank 20 is decreased. However, fuel is prevented from decreasing, so that fuel drawn by the fuel pump 32 can be secured in the sub-tank 20.

Besides, the transfer pipe 82 is included in the fuel tank 2 for transferring fuel received in the second-tank section 4 into the sub-tank 20 disposed in the first-tank section 3 in this structure. Accordingly, the number of opening sections formed in the fuel tank 2 decreases compared with a case in which the transfer pipe 82 passes through a wall of the fuel tank 2 and partially provided outside of the fuel tank 2. Therefore, the number of sealing sections decreases in the fuel tank 2. Here, the sealing sections are formed for preventing leakage of fuel evaporated in the fuel tank 2 to outside of the fuel tank 2.

The jet pump 70 can be horizontally located. In this case, the nozzle 72 of the jet pump 70 is located in the upper section of the auxiliary chamber 102, so that fuel liquid level can be set at high position in the auxiliary chamber 102, when the fuel pump 32 is stopped.

In this structure, the fuel pump 32 supplies fuel from the vent hole 202 to the jet pumps 60, 70. Fuel supplied from the vent hole 202 is not pressure controlled by the pressure regulator 48.

An amount of fuel supplied from the vent hole 202 to the jet pumps 60, 70 is substantially constant regardless of a fuel consumption amount in the engine side. Accordingly, an amount of fuel jetted by the jet pump 60 from the first-tank section 3 into the sub-tank 20 is substantially constant. Besides, an amount of fuel jetted by the jet pump 70 from the second-tank section 4 into the sub-tank 20 is also substantially constant. Accordingly, substantially constant fuel amount can be secured in the sub-tank 20 regardless of a fuel consumption amount in the engine side. Therefore, fuel shortage in the sub-tank 20 can be prevented. Besides, overflowing a large amount of fuel from the sub-tank 20 into the fuel tank 2 and the first-tank section 3 can be prevented. Here, if a large amount of fuel overflows from the sub-tank 20 into the fuel tank 2, fuel received in the fuel tank 2 is agitated and the agitated fuel is evaporated to be vapor in the fuel tank 2. Furthermore, if fuel overflowing from the sub-tank 20 drops onto the inner bottom surface of the fuel tank 2, noise may be made. In this structure, generation of fuel vapor can be prevented in the fuel tank 2, and noise made due to dropping fuel in the fuel tank 2 can be reduced.

In this structure, the check valve 44 is received in the inlet port 42 of the filter case 41 which is fitted to the discharge port 38 of the fuel pump 32. Accordingly, a space formed between the pressurizing section 33 of the fuel pump 32 and the check valve 44 becomes small. Intermediately pressurized fuel is supplied to both of the jet pumps 60, 70. Besides, the check valve 44 is arranged in the upstream side of an inlet space of the filter element 43 (discharge side filter) in the fuel filter 41. Therefore, fuel supplied to the jet pumps 60, 70 does not pass through the fuel discharge port 38 of the fuel pump 32 and a space around the filter element 43, so that a dead volume is reduced. That is, a volume formed between the pressurizing section 33 of the fuel feed apparatus 1 and the check valve 44 can be reduced.

Besides, the check valve 44 prevents discharged fuel from reverse flowing into the side of the fuel pump 32. Accordingly, fuel pressure in the downstream side of the check valve 44 is retained while the engine is stopped. That is, the check valve 44 maintains fuel pressure in the downstream side of the check valve 44 (i.e., pressure of fuel supplied to the engine side), when the fuel pump 32 is stopped. The engine is started and the fuel pump 32 is started, fuel is quickly pressurized in the space formed between the pressurizing section 33 of the fuel pump 32 and the check valve 44. Therefore, when the fuel feed apparatus 1 is started, pressure of fuel supplied by the fuel feed apparatus 1 can become the predetermined pressure within a short period. Fuel is quickly pressurized up to a predetermined pressure, and the pressurized fuel can be supplied to the engine within a short period. Thus, a starting operation of the engine can be quickly performed.

The number of the tank section can be three or more. In this case, two or more tank sections, except for the first-tank section 3, can be used as the second-tank sections 4. The second jet pumps 70 are respectively provided in the second-tank sections 4, and fuel in the second-tank sections 4 can be transferred into the first-tank section 3 receiving the fuel feed apparatus 1. Alternatively, one of two or more tank sections, except for the first-tank section 3, can be used as the second-tank sections 4, for example. Combination of the number of the tank-sections in the fuel tank 2 and the number of the second-tank sections 4 can be freely determined.

Fuel discharged from the fuel pump 32 is pressure-controlled by the pressure regulator 48 at a substantially constant pressure. Here, fuel, which is pressure-controlled by the pressure regulator 48, can be partially supplied to the jet pumps 60, 70. In this case, pressure of fuel supplied to the jet pumps 60, 70 becomes substantially constant. If an amount of fuel supplied into the sub-tank 20 needs to be changed, the diameter of the nozzles 62, 72 of the jet pumps 60, 70 can be changed. Thus, flow amount of fuel supplied into the sub-tank 20 by the jet pumps 60, 70 can be adjusted.

The jet pump 70 can be arranged outside of the sub-tank 20. In this case, the jet pump 70 is received in the first-tank section 3, and transfers fuel from the second-tank section 4 into the first-tank section 3.

In this invention, pressurized fuel by the fuel pump is the fuel intermediately pressurized in the fuel pump 32 and the fuel discharged from the fuel pump 32. The fuel intermediately pressurized in the fuel pump 32 is drawn from the midstream of the pressurizing section 33 to the jet pumps 60, 70. The fuel discharged from the fuel pump 32 is completely pressurized fuel in the fuel pump 32 and supplied to the engine side or the like.

[Second Embodiment]

Figure 6:
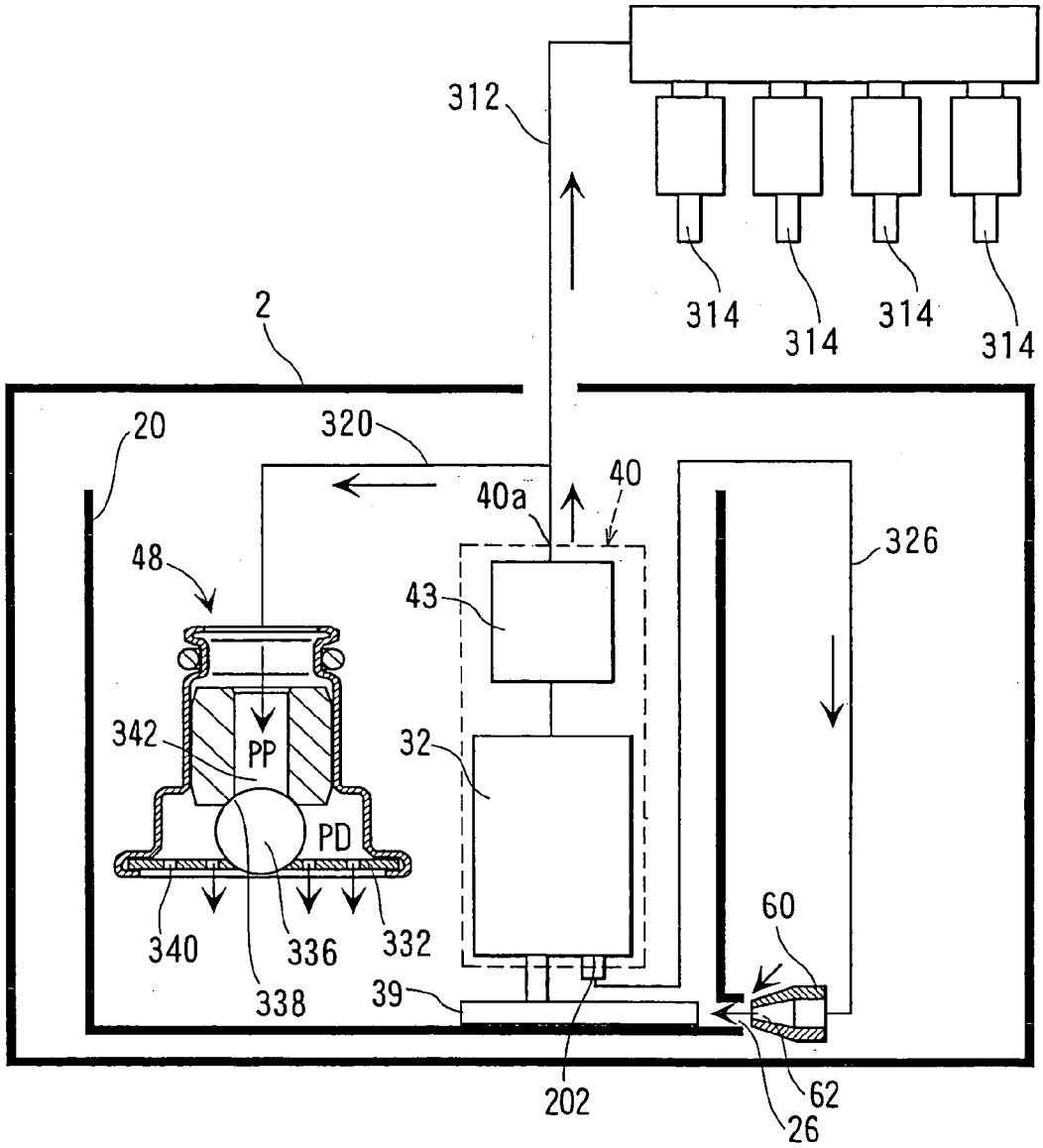
FIG. 6 is a schematic diagram showing a fuel feed apparatus according to a second embodiment in the present invention.

As shown in FIG. 6, fuel is pressurized in the fuel pump 32 and discharged from the vent hole 202 of the fuel pump 32. The vent hole 202 is connected with the jet pump 60 through a first pipe 326. The first pipe 326 is equivalent to the nylon pipe 50 in the first embodiment.

Figure 7:
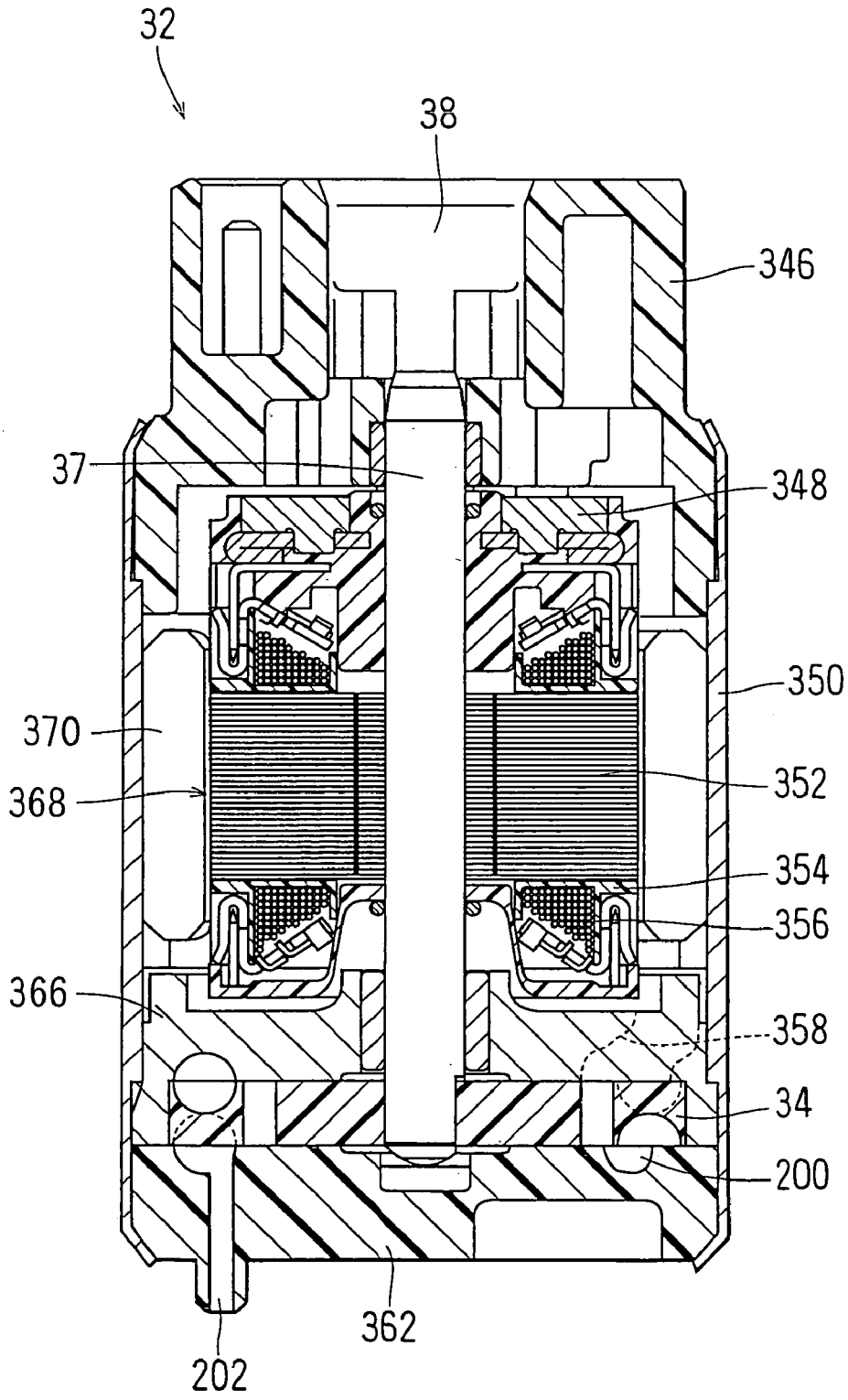
FIG. 7 is a cross-sectional view showing the fuel pump of the fuel feed apparatus.

As shown in FIG. 7, the fuel pump 32 has a housing 350. The housing 350 receives a discharge-side cover 346, an armature 368, four magnets 370, a casing 366, suction-side cover 362 and the like. Each magnet 370 is shaped in an arc-shape in its cross-section. The four arc-shaped magnets 370 are arranged in the inside peripheral wall of the housing 350 in a predetermined interval, so that different magnetic poles are alternatively formed in the circumferential direction of the housing 350.

The armature 368 is rotatably received in the housing 350 with the shaft 37. A commutator 348 is provided on the one end of the armature 368. The shaft 37 is press-inserted into a core 352. Multiple bobbins 354 are provided on the core 352. A coil 356 is wound around each bobbin 354. The commutator 348 is constructed with multiple segments. The multiple segments are insulated each other. Each coil 356 wound around each bobbin 354 is electrically connected with each segment of the commutator 348.

The pressurizing passage 200 is formed between the suction-side cover 362 and the casing 366. The impeller 34 is rotatably received in the vicinity of the pressurizing passage 200. The impeller 34 is formed in a disc-shape. Multiple vanes are formed on the outer periphery section of the disc-shaped impeller 34. The impeller 34 is rotated with the shaft 37 of the armature 368, so that fuel is pressurized in the pressurizing passage 200. A fuel inlet port 374 (FIG. 8) is formed in the suction-side cover 362. Fuel is drawn into the pressurizing passage 200 through the fuel inlet port 374, and discharged from the pressurizing passage 200 through a communication passage 358. The fuel flowing from the communication passage 358 passes through the discharge port 38 formed in the discharge-side cover 346 of the fuel pump 32, and is discharged from the fuel pump 32.

Figure 8:
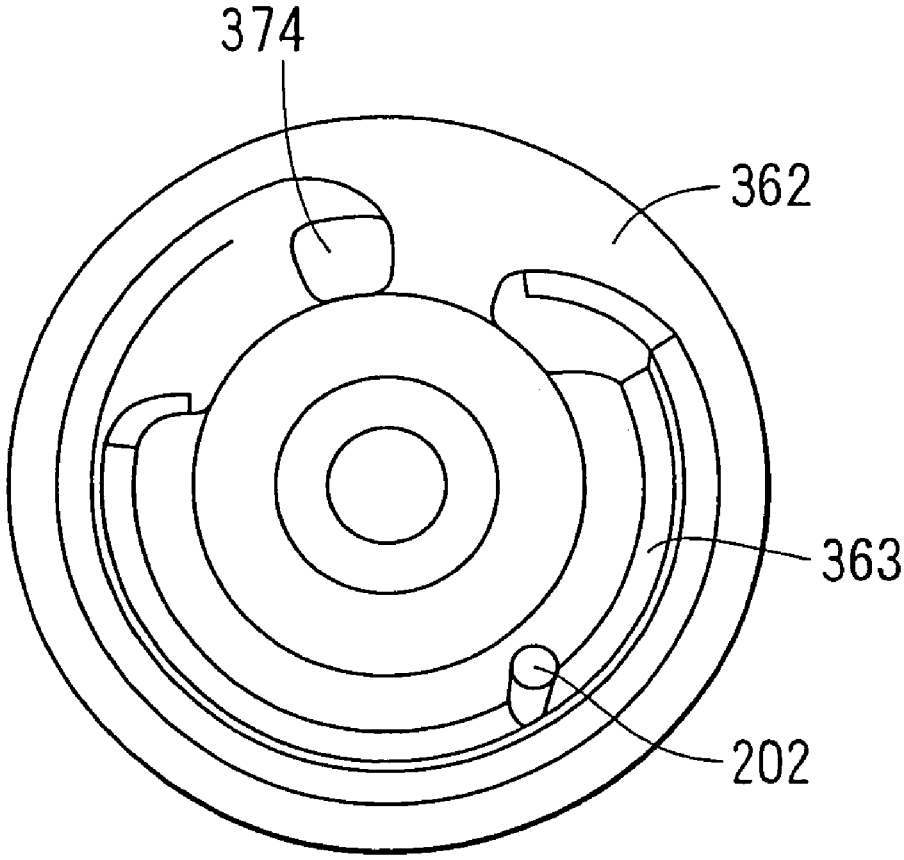
FIG. 8 is a top view showing a suction-side cover of the fuel feed apparatus.

As shown in FIG. 8, a C-shaped trench 363 is formed in the suction-side cover 362 for forming the pressurizing passage 200. The fuel inlet port 374 is formed in one end section of the C-shaped trench 363 of the suction-side cover 362 for drawing fuel. The vent hole 202 is formed in the central section of the C-shaped trench 363 for exhausting vapor.

Referring back to FIG. 6, the first pipe 326 is connected with the vent hole 202 of the fuel pump 32 for introducing fuel exhausted from the vent hole 202 to the jet pump 60. Vapor is generated in the pressurizing passage 200 while the impeller 34 rotates, and the generated vapor is exhausted from the vent hole 202 with intermediately pressurized fuel. The exhausted fuel from the vent hole 202 is supplied to the jet pump 60 and jetted into the sub-tank 20 from the nozzle 62 of the jet pump 60.

A second pipe 312 is connected with a discharge port **40*a* of the pump module 40, which is located in the downstream side of the filter element 43, for supplying fuel to injectors 314 provided in the engine. A third pipe 320 is branched from the second pipe 312, and connected with the pressure regulator 48**, in this embodiment.

A valve port 342 is formed in the pressure regulator 48, and connected with the second pipe 312 through the third pipe 320. Fuel discharged from the fuel pump 32 is introduced into the pressure regulator 48 through the second pipe 312 and the third pipe 320. The fuel introduced into the pressure regulator 48 is exhausted into the sub-tank 20 when a spherical-shaped valve body 336 is moved and the valve port 342 is communicated to the inside of the sub-tank 20. A valve seat 338 is formed in the periphery on the outlet side of the valve port 342. The spherical-shaped valve body 336 is provided in the downstream side of the valve seat 338. The pressure regulator 48 opens to its downstream side, and a leaf spring (urging unit) 332 is provided in the opening side of the pressure regulator 48. The leaf spring 332 urges the valve body 336 to the valve seat 338 located in the upstream side. Therefore, the valve body 336 is urged from the downstream side by the leaf spring 332, and seated on the valve seat 338. Multiple penetrating holes 340 are formed in the leaf spring 332. Fuel flowing out of the valve port 342 is exhausted into the sub-tank 20 through the penetrating holes 340 formed in the leaf spring 332. In detail, when fuel pressure exceeds a predetermined pressure in the second pipe 312 (i.e., in the valve port 342), the valve body 336 is displaced to the downstream side opposing to an urging force of the leaf spring 332. In this case, the valve body 336 is displaced to the downstream side, and lifted from the valve seat 338, while the valve port 342 is communicated to the inside of the sub-tank 20. Fuel flowing in the second pipe 312 is exhausted through the third pipe 320 and the valve port 342, so that fuel pressure in the second pipe 312 is controlled. The fuel can be exhausted from the pressure regulator 48 into the fuel tank 2, instead of exhausting into the sub-tank 20.

In this structure, a diaphragm is not used in the pressure regulator 48, so that the structure of the pressure regulator 48 can be simplified.

Pressure (high pressure) Pp of fuel flowing in the second pipe 312 and drain pressure Pd works on the valve body 336 from fuel surrounding the valve body 336. Here, the drain pressure Pd is pressure on the side of the leaf spring 332 in the pressure regulator 48 with respect to the valve body 336. The drain pressure Pd works on the valve body 336 in the opposite direction of the high pressure Pp. That is, differential pressure F between high pressure Pp and pressure Pd works on the valve body 336.

$$F=(Pp-Pd)\times A1 \quad (1)$$

A1: flow area of the valve port 342

Here, the fuel pressure flowing in the second pipe 312 is substantially equivalent to pressure of fuel pressurized by the fuel pump 32.

The high pressure Pp in the second pipe 312 and the drain pressure Pd works in the same area on the valve body 336. However, the high pressure Pp pressurized in the fuel pump 32 is much larger than the drain pressure Pd, so that force working on the valve body 336 does not largely change by fluctuation of drain pressure Pd.

Specifically, the valve body 336 is pressed by the high pressure Pp of the second pipe 312 from the upstream side. The high pressure from the upstream side works on the valve body 336 in a flow area of the valve port 342, so that the valve body 336 is lifted from the valve seat 338 located on the upstream side of the valve body 336. The valve body 336 is urged by the leaf spring 32. The drain pressure Pd on the downstream side of the valve body 336 works on the valve body in the substantially same area of the valve port 342. Therefore, the urging force of the leaf spring 332 and the drain pressure Pd in the downstream side of the valve body 336 works on the valve body 336, so as to sit the valve body 336 on the valve seat. In this structure of the pressure regulator 48, the valve body 336 is provided on the downstream side of the valve seat 338. Therefore, high pressure Pp works on the valve body 336 from the upstream side for lifting from the valve seat 338, and drain pressure Pd works on the valve body 336 from the downstream side for sitting to the valve seat 338. Both of the fuel pressure Pp, Pd works on the valve body 336 in the substantially same area.

Figure 10:
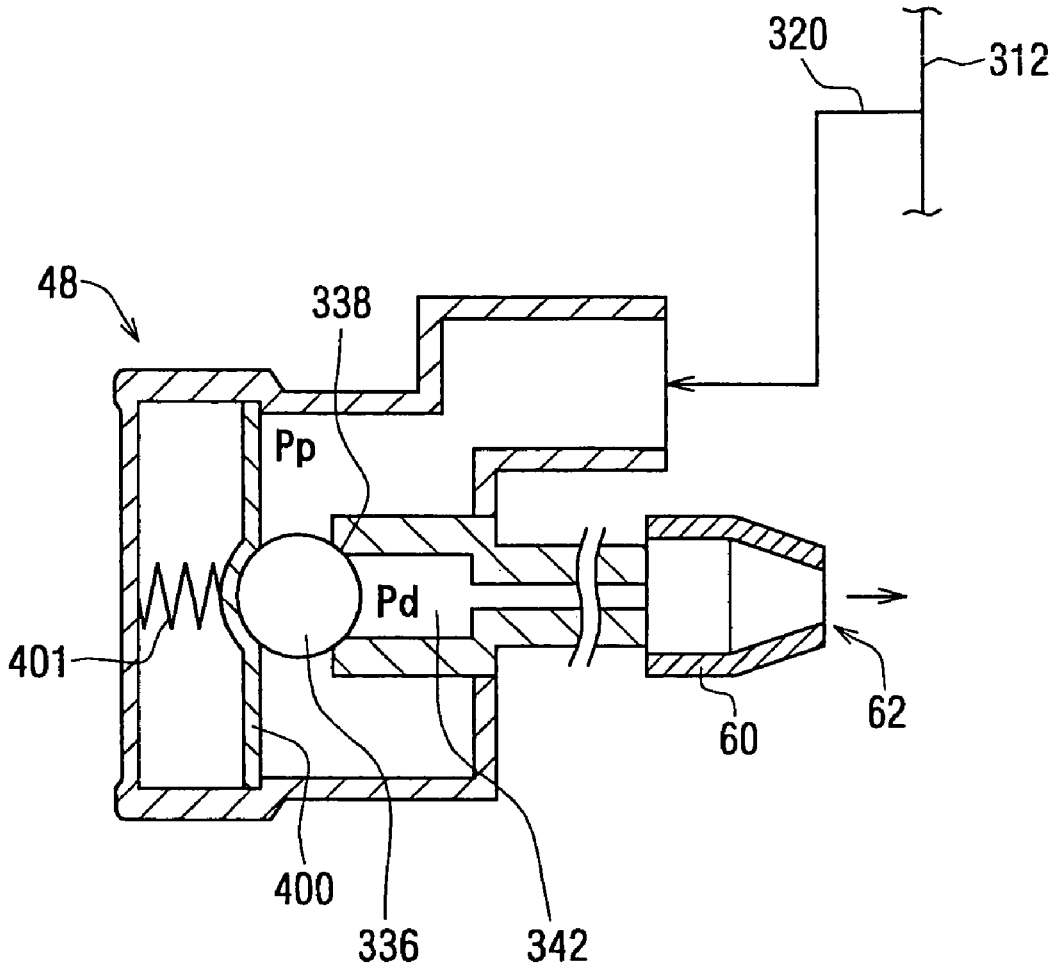
FIG. 10 RELATED ART
FIG. 10 is a cross-sectional view showing a pressure regulator according to a related art.

By contrast, in a pressure regulator 48 shown in FIG. 10, the valve body 336 is provided in the upstream side of the valve seat 338, and a diaphragm 400 receives high-pressure Pp in the second pipe 312. The high-pressure Pp works on a wider area of the diaphragm 400 compared with the structure of the pressure regulator 48 (FIG. 6) in this embodiment. If the diaphragm 400 is used in the pressure regulator 48, pressure-control characteristic of the pressure regulator 48 is not apt to be changed.

On the contrary, in the structure of the pressure regulator 48 in this embodiment, both of the high pressure Pp and the drain pressure Pd works on the valve body 336 in the substantially same area. Therefore, the pressure-control characteristic of the pressure regulator 48 is apt to be largely changed, when the drain pressure Pd is changed. Especially, if the jet pump 60 is provided in the downstream of the pressure regulator 48, the drain pressure Pd is apt to be changed depending on the downstream pressure of the pressure regulator 48.

However, in this embodiment, fuel is supplied to the jet pump 60 from the upstream side of the valve port 342 of the pressure regulator 48. Therefore, the variation of the pressure control characteristic of the pressure regulator 48 does not be largely affected by the jet pump 60, (i.e., change of flow characteristic of the jet pump 60, or the like) in this structure. Therefore, the structure of the pressure regulator 48 can be simplified in this embodiment, while securing stable control characteristic of the pressure regulator 48. Furthermore, the structure of the pressure regulator 48 can be easily downsized, because the pressure regulator 48 does not use a diaphragm. Therefore, large pressure-receiving area is not needed for the pressure regulator 48 in this embodiment, dissimilar to a pressure regulator using a diaphragm (FIG. 10). That is, in this embodiment, a pressure-controlling characteristic is stable in the pressure regulator 48, so that pressure of fuel supplied to the injectors 314 becomes stable.

Besides, fuel is drawn from the vent port 202 and supplied to the jet pump 60. The pressure of the fuel drawn from the vent port 202 is lower than pressure of fuel discharged from the discharge port 38 of the fuel pump 32. Therefore, the jet pump 60 can be driven by the fuel drawn from the vent port 202, without decreasing efficiency of the fuel pump 32.

A coil spring can be used instead of the leaf spring 332 in the pressure regulator 48. Even in this case, a diaphragm is not used in the pressure regulator 48, so that the pressure regulator 48 can be simplified and downsized compared with a pressure regulator 48 using a diaphragm.

[Third Embodiment]

Figure 9:
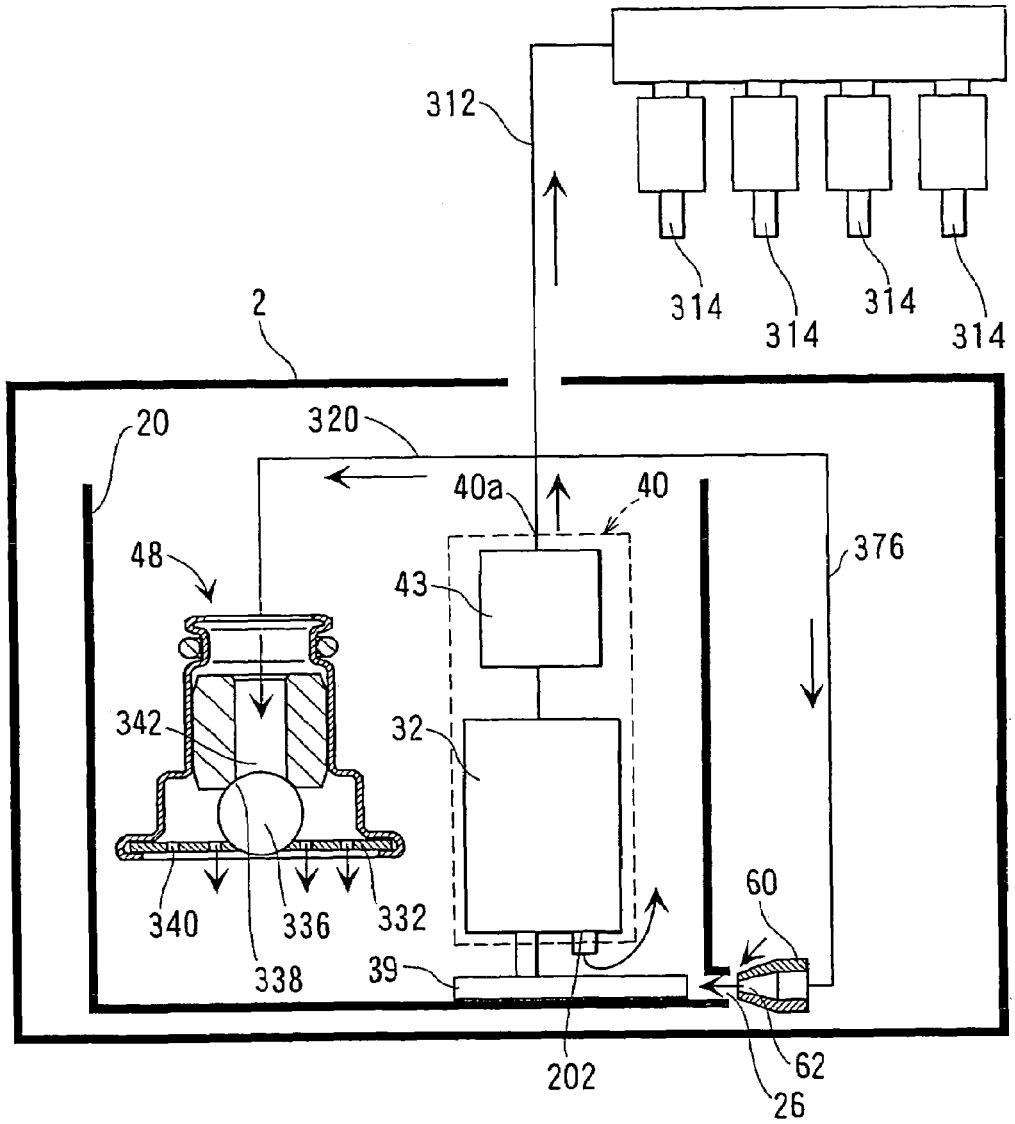
FIG. 9 is a schematic diagram showing a fuel feed apparatus according to a third embodiment in the present invention.

As shown in FIG. 9, fuel is drawn from the second pipe 312, and supplied into the jet pump 60 in this embodiment.

Specifically, a fourth pipe 376 is connected with the second pipe 312 for introducing fuel discharged from the discharge port 40*a* of the pump module 40 into the jet pump 60. Fuel is pressurized in the fuel pump 32 by rotation of the impeller 34, and flows into the second pipe 312 through the filter element 43. Fuel flowing in the second pipe 312 is partially introduced into the jet pump 60 through the fourth pipe 376. The fuel introduced into the jet pump 60 is jetted from the nozzle 62 into the sub-tank 20. The amount of fuel introduced into the jet pump 60 corresponds to the flow passage area of the nozzle 62 of the jet pump 60.

Fuel is introduced from the upstream side of the valve port 342 of the pressure regulator 48 into the jet pump 60. Accordingly, pressure in the downstream side of the pressure regulator 48 is not affected by the jet pump 60, so that characteristic of pressure control of the pressure regulator 48 can be stabilized. Therefore, fuel completely pressurized by the fuel pump 32 can be introduced into the jet pump 60 without passing through the pressure regulator 48 in this embodiment.

Various modifications and alternations may be made to the above embodiments without departing from the spirit of the present invention.

The invention claimed is:

1. A fuel feed apparatus received in a first-tank section included in a fuel tank having a plurality of tank sections, the fuel feed apparatus supplying fuel received in the fuel tank to outside of the fuel tank and comprising:

a sub-tank received in the first-tank section;

a pump module received in the sub-tank for drawing fuel received in the sub-tank and pressurizing the fuel;

a first jet pump arranged in the first-tank section for generating suction power by jetting fuel for supplying fuel received in the first-tank section into the sub-tank; and a second jet pump arranged in the sub-tank for generating suction power by jetting fuel for supplying fuel received in a second-tank section included in the fuel tank into the sub-tank.

2. The fuel feed apparatus according to claim 1, further comprising:

an inlet port through which fuel received in the second-tank section flows into the sub-tank; and a reverse flow preventing unit for preventing fuel received in the sub-tank from flowing out of the inlet port.

3. The fuel feed apparatus according to claim 2, wherein:

the sub-tank has an inner space partitioned by a partition wall into a first chamber and an second chamber;

the first chamber includes the pump module; and the second chamber includes the second jet pump.

4. The fuel feed apparatus according to claim 1, further comprising a transfer pipe for transferring fuel received in the second-tank section into the sub-tank by the suction power generated by the second jet pump, wherein the transfer pipe is received in the fuel tank.

5. The fuel feed apparatus according to claim 1, wherein the second jet pump jets fuel to a bottom section of the sub-tank.

6. The fuel feed apparatus according to claim 5, wherein the bottom section of the sub-tank forms a fuel accumulator for receiving fuel jetted from the second-jet pump.

7. The fuel feed apparatus according to claim 1, wherein: the pump module is eccentrically arranged in the sub-tank; and the first jet pump and the second jet pump are arranged in a substantially opposite side of the pump module with respect to a central axis of the sub-tank.

* * * * *